US008333371B2

(12) United States Patent
Kikkawa et al.

(10) Patent No.: US 8,333,371 B2
(45) Date of Patent: Dec. 18, 2012

(54) CREASING DEVICE AND IMAGE FORMING SYSTEM

(75) Inventors: Naohiro Kikkawa, Kanagawa (JP); Hitoshi Hattori, Tokyo (JP); Takashi Saito, Kanagawa (JP); Shuuya Nagasako, Kanagawa (JP); Naoyuki Ishikawa, Kanagawa (JP); Yuusuke Shibasaki, Kanagawa (JP); Hidetoshi Kojima, Miyagi (JP); Naoki Oikawa, Miyagi (JP); Go Aiba, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 41 days.

(21) Appl. No.: 12/926,420

(22) Filed: Nov. 17, 2010

(65) Prior Publication Data

US 2011/0130260 A1 Jun. 2, 2011

(30) Foreign Application Priority Data

Nov. 27, 2009 (JP) ..... 2009-270197

(51) Int. Cl.
*B31B 1/25* (2006.01)
*B31F 1/08* (2006.01)

(52) U.S. Cl. ..... 270/45; 270/32; 270/58.07

(58) Field of Classification Search ..... 270/32, 270/37, 45, 46, 58.07; 493/59, 355, 396, 493/397, 240, 242
See application file for complete search history.

(56) References Cited

U.S. PATENT DOCUMENTS

| | | | | |
|---|---|---|---|---|
| 7,416,177 | B2 | 8/2008 | Suzuki et al. | |
| 7,740,238 | B2 * | 6/2010 | Iijima et al. | 270/37 |
| 7,798,480 | B2 | 9/2010 | Kikkawa et al. | |
| 7,913,988 | B2 * | 3/2011 | Awano | 270/45 |
| 2004/0256783 | A1 | 12/2004 | Iida et al. | |
| 2006/0055100 | A1 | 3/2006 | Suzuki et al. | |
| 2008/0179809 | A1 | 7/2008 | Kikkawa et al. | |
| 2008/0211159 | A1 * | 9/2008 | Iijima et al. | 270/37 |
| 2009/0039593 | A1 | 2/2009 | Kikkawa et al. | |
| 2009/0152789 | A1 | 6/2009 | Kikkawa et al. | |
| 2009/0181840 | A1 * | 7/2009 | Awano | 493/399 |
| 2009/0258774 | A1 | 10/2009 | Suzuki et al. | |

FOREIGN PATENT DOCUMENTS

| | | |
|---|---|---|
| JP | 2008-081258 | 4/2008 |
| JP | 2009-166928 | 7/2009 |

* cited by examiner

*Primary Examiner* — Leslie A Nicholson, III
(74) *Attorney, Agent, or Firm* — Harness, Dickey & Pierce, P.L.C.

(57) ABSTRACT

A creasing device includes: a first member on which a linear convex-edged blade is formed in a direction perpendicular to a sheet conveying direction; a second member on which a concave-edged blade pairing with the convex-edged blade is formed; and a drive unit that drives the first and second members to relatively come close to and away from each other, thereby making a crease on the sheet, wherein in a standby state, the drive unit keeps faces of the first member and second member not parallel; and in making a crease on the sheet, causes the convex-edged blade and the concave-edged blade to have point contact with each other via the sheet held therebetween so as to initiate a creasing movement by a rotation movement thereof.

8 Claims, 12 Drawing Sheets

| FIG. 21A |
| --- |
| FIG. 21B |

CREASING DEVICE AND IMAGE FORMING SYSTEM

CROSS-REFERENCE TO RELATED APPLICATIONS

The present application claims priority to and incorporates by reference the entire contents of Japanese Patent Application No. 2009-270197 filed in Japan on Nov. 27, 2009.

BACKGROUND OF THE INVENTION

1. Field of the Invention

The present invention relates to a creasing device for making a crease in a bundle of sheet-like members (hereinafter, referred to as "sheet(s)") conveyed from a preceding stage before the sheet bundle is saddle-stitched and center-folded in half, and an image forming system including the creasing device and an image forming apparatus.

2. Description of the Related Art

Conventionally, so-called center-fold or center-fold binding is performed on a bundle of a plurality of sheets discharged from an image forming apparatus, in which the sheet bundle is saddle-stitched and then folded in the middle. If a sheet bundle composed of a plurality of sheets is folded at one time, an amount of stretch of a fold portion of the sheet on the outer side of the sheet bundle is larger than that of the sheet on the inner side. Consequently, at the fold portion of the outer-side sheet, a formed image area is stretched, and may result in damage on the image area, such as toner detachment. The same phenomenon occurs in other folding processes, such as Z-fold and three-fold. Furthermore, depending on the thickness of the sheet bundle, the sheet bundle may not be sufficiently folded.

To cope with such problems, there has been known a creasing device called creaser that makes a crease in a fold portion of each sheet in advance before a sheet bundle is folded in two or the like to make it easy to fold the outer-side sheet as well, and thereby prevents toner detachment. Such creasing devices include ones that make a crease in a direction perpendicular to a conveying direction by causing a roller to run, quenching with a laser, pressing a creasing blade against a sheet, or the like.

For example, the invention disclosed in patent document 1 (Japanese Patent Application Laid-open No. 2008-081258) is developed for the purpose of making a well-shaped and highly-accurate crease depending on a type of sheet; in this invention, an annular convex portion is formed on the outer circumference of a roller for making a crease and an annular concave portion is formed on the outer circumference of a roller pairing with the roller, and by causing a sheet to pass through a nip between the rollers, a crease along a sheet conveying direction is made in the sheet. It is configured that the rollers can be replaced with most preferable rollers depending on a sheet.

Furthermore, according to the invention disclosed in patent document 2 (Japanese Patent Application Laid-open No. 2009-166928), a creasing device is provided with a creasing member for making a crease extending along a predetermined line of a recording medium in the predetermined line of the recording medium, an insertion groove that is formed at a site opposed to the creasing member and into which the creasing member can be inserted, and a back-and-forth movement driving unit that drives the creasing member to move forward and backward between a standby position and a creasing position in a state where the predetermined line of the recording medium is placed between the creasing member and the insertion groove; at the time of making a crease in a direction perpendicular to a sheet conveying direction, the crease is made while reducing a pressing force applied by the creasing member, so the creasing member is moved while changing the timing to move by a plurality of individual back-and-forth movement mechanisms.

However, when a crease is made with a roller like the invention disclosed in the patent document 1, the roller is moved by a distance corresponding to the length or width of a sheet, so it takes a certain time for the roller to move, and therefore, there is a problem that it takes a longer processing time. To resolve this problem, there is a method of turning the sheet conveying direction by 90 degrees and making a crease parallel to the conveying direction in the sheet being conveyed; however, this method causes an increase in an installation area. In the case of making a crease with a laser, there is a problem that smoke or a burning smell is produced during creasing. In the case of making a crease with a creasing blade, although the crease can be easily made in a direction perpendicular to the conveying direction in a short processing time, the load is increased if an overall face of the creasing blade is simultaneously pressed against a sheet, and a larger driving force is required to make the crease.

In the invention disclosed in the patent document 2, to reduce the load, it is configured to make a crease while reducing a pressing force applied by the creasing member, and the creasing member is moved while changing the timing to move by the plurality of individual back-and-forth movement mechanisms. However, if the face of the creasing blade is brought into contact with the sheet in several batches, an uneven crease between a several-time contact portion and a one-time contact portion is made, so the creasing may not be done properly.

An object of the present invention is to shorten a time required to make a crease in a direction perpendicular to a conveying direction and reduce the load at the time of making the crease thereby improving the productivity and energy consumption.

SUMMARY OF THE INVENTION

It is an object of the present invention to at least partially solve the problems in the conventional technology.

According to an aspect of the present invention, there is provided a creasing device for making a crease on one sheet each, the creasing device including: a first member on which a linear convex-edged blade is formed in a direction perpendicular to a sheet conveying direction; a second member on which a concave-edged blade pairing with the convex-edged blade is formed; and a drive unit that drives the first and second members to relatively come close to and away from each other, thereby causing the first member and second member to hold the sheet that is stopped at a predetermined position therebetween and make a crease on the sheet, wherein when it is in a standby state, the drive unit keeps the first member and second member in a state where a face of the convex-edged blade to have contact with the sheet is not parallel to a face of the concave-edged blade; and at the time of making a crease on the sheet, the drive unit causes the first member and second member to be in a state where the convex-edged blade and the concave-edged blade have point contact with each other via the sheet held therebetween so as to initiate a creasing movement by a rotation movement thereof.

According to another aspect of the present invention, there is provided an image forming system including: the creasing device mentioned above; and an image forming apparatus that forms an image on the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
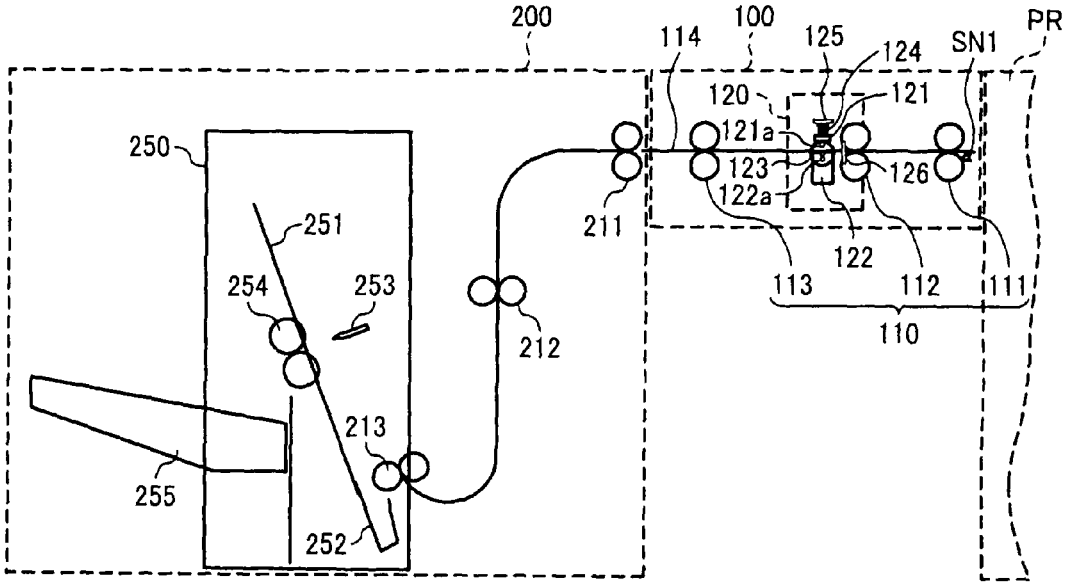
FIG. 1 is a diagram illustrating a schematic configuration of an image forming system according to the present invention.

A feature of the present invention is that at the time of making a crease, although a creasing blade is simultaneously operated, the creasing blade is gradually brought into contact with a sheet from an edge face of the sheet, and therefore, the load on a creasing moving unit is reduced, and an even crease is made by one-time contact of a creasing unit with the sheet so that surface irregularities on the sheet can be prevented from occurring.

An embodiment of the present invention is explained below with reference to the accompanying drawings.

Incidentally, in an embodiment described below, the creasing device corresponds to a reference numeral 100; the convex-edged blade corresponds to a creasing blade 121*a*; the first member corresponds to a creasing member 121; the concave-edged blade corresponds to a creasing groove 122*a*; the second member corresponds to a creasing board 122; the drive unit corresponds to a drive motor 130, a drive gear train 135, a camshaft 134, drive cams 123*a* and 123*b*, and positioning members 131*a* and 131*b*; the support point corresponds to a rotating shaft 121Q; the elastic member corresponds to reference numerals 124*a* and 124*b*; and the image forming apparatus corresponds to a reference symbol PR.

FIG. 1 is a diagram illustrating a schematic configuration of an image forming system according to the present invention. The image forming system is basically composed of an image forming apparatus PR that forms an image on a sheet, a creasing device 100 that makes a crease in the sheet, and a fold processing apparatus 200 that performs a folding process (post-processing) on the sheet on which the crease has been made.

The image forming apparatus PR forms a visible image of image data input from a scanner, a personal computer (PC), or the like on a sheet and outputs the sheet. A publicly-known imaging engine, such as an electrophotographic imaging engine or a droplet-discharge imaging engine, is used in the image forming apparatus PR.

The creasing device 100 includes a conveying mechanism 110 and a creasing mechanism 120. The creasing mechanism 120 includes a creasing member 121 and a creasing board 122. By holding a sheet between the creasing member 121 and the creasing board 122, a linear crease is made in the sheet. On an edge face of the creasing member 121 opposed to the creasing board 122, a creasing blade (a convex-edged blade) 121*a* for making a crease is linearly installed in a direction perpendicular to a sheet conveying direction. The creasing member 121 is formed into a pointed blade-like shape. On the other hand, on a face of the creasing board 122 opposed to the creasing blade 121*a*, a creasing groove 122*a* (a concave-edged blade), into which the pointed edge of the creasing blade 121*a* is fitted, is formed. As the creasing member 121 and the creasing board 122 are formed into such shapes, when a sheet is held between them, a crease is made in the sheet by the pointed edge (the convex-edged blade) and the groove (the concave-edged blade).

The creasing member 121 is constantly elastically biased in a direction of the creasing board 122 by an elastic member 124, such as a compression spring, and is driven to move up and down by a drive cam 123. Incidentally, an upper end of the elastic member 124 in the drawing is restrained by a spring fixation member 125.

The conveying mechanism is composed of a first conveying roller 111, a second conveying roller 112, and a third conveying roller 113, and conveys a sheet that is introduced from the image forming apparatus PR to a subsequent stage. Incidentally, just before the first conveying roller 111 arranged on the most upstream side, an inlet sensor SN1 for detecting front and back ends of a sheet that is introduced into the creasing device 100 is installed. Furthermore, just behind the second conveying roller 112 installed in the creasing mechanism 120, a stopper plate 126, to which the front end of the sheet butts, is movably installed so that the stopper plate 126 can move up and down with respect to a conveyance path 114.

The fold processing apparatus 200 includes a center-folding unit 250 which performs a folding process. When a sheet, on which a crease has been made by the creasing device 100, is introduced into the fold processing apparatus 200, the sheet is brought to the center-folding unit 250 by conveying rollers 211, 212, and 213 composing a conveying mechanism.

The center-folding unit 250 includes a center-fold processing tray 251, a back end fence 252 installed at a lower end (on the most upstream side in the conveying direction) of the center-fold processing tray 251, a folding plate 253 and folding rollers 254 for folding a sheet along a crease, and a catch tray 255. The back end fence 252 is used to align a sheet on the conveying direction. A back end of a sheet discharged into the center-fold processing tray 251 is forcibly pressed against the back end fence 252 by a return roller (not shown), thereby aligning the sheet. Furthermore, the sheet is also aligned in a direction perpendicular to the conveying direction with a jogger fence (not shown).

A front end edge of the folding plate 253 is pressed against a bundle of aligned sheet along the crease, thereby pushing the sheet bundle into a nip of the folding rollers 254. In this way, the sheet bundle is pushed into the nip of the folding rollers 254, and a crease is made in the sheet bundle by the nip. In the case of performing a saddle-stitch process on a sheet bundle, after a portion of the sheet bundle, on which a crease is made, is stitched by a stitching device (not shown), the folding process is performed on the sheet bundle. This folding process is called two-fold. The sheet bundle folded in two is discharged out into the catch tray 255 and stacked on the catch tray 255.

Figure 2:
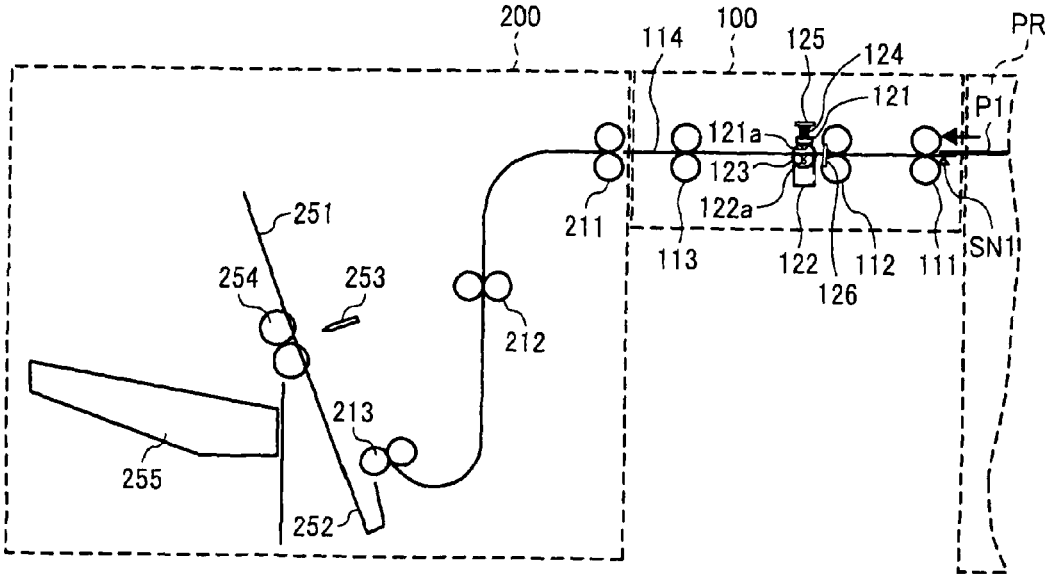
FIG. 2 is an explanatory diagram illustrating a sequence of operations of the image forming system when performing a folding process, and shows a state where a sheet is introduced into a creasing device.
Figure 3:
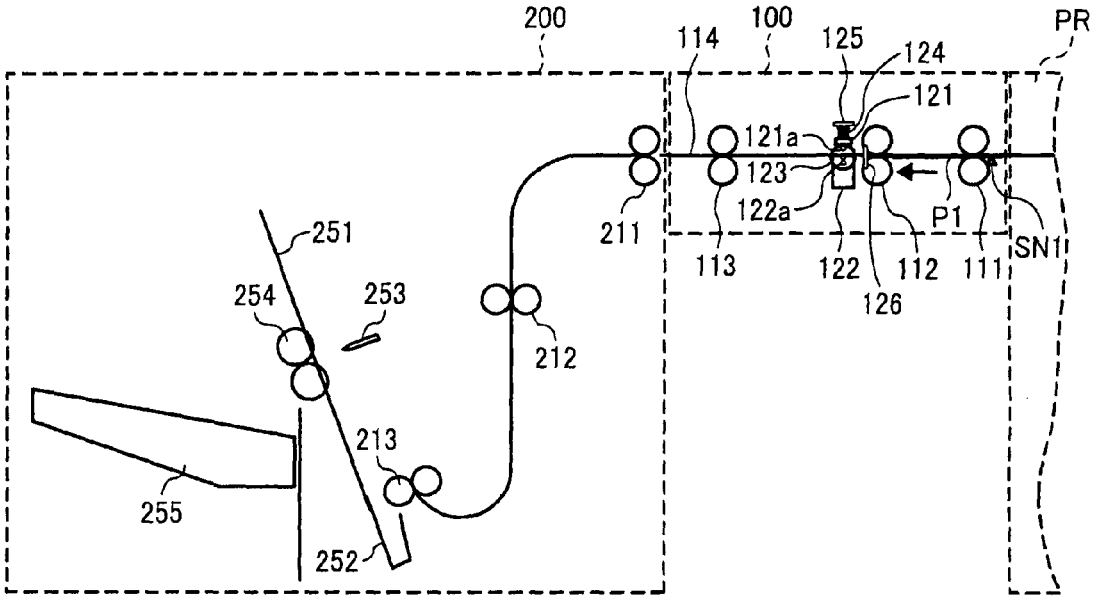
FIG. 3 is an explanatory diagram illustrating the sequence of operations of the image forming system when performing the folding process, and shows a state where a front end of the sheet butts into a stopper plate in front of a creasing section.
Figure 4:
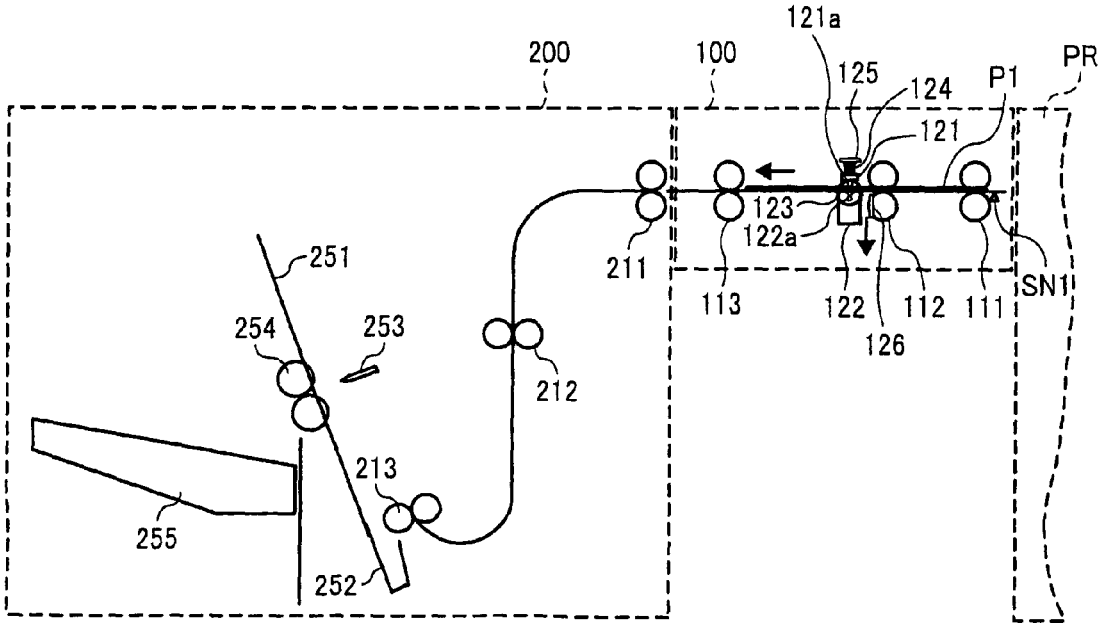
FIG. 4 is an explanatory diagram illustrating the sequence of operations of the image forming system when performing the folding process, and shows a state where the stopper plate is retracted away from a conveyance path and the sheet is conveyed.

FIGS. 2 to 12 are explanatory diagrams illustrating a sequence of operations of the image forming system when performing this folding process. In this image forming system, a sheet P1 on which an image has been formed in the image forming apparatus PR is introduced into the creasing device 100 (FIG. 2). A front end of the sheet butts into the stopper plate 126 projecting into the conveyance path 114 to correct a skew (FIG. 3), and then a skew of the sheet P1 is corrected. After that, when the stopper plate 126 is retracted away from the conveyance path 114 as indicated by an arrow, the sheet P is again conveyed on the conveyance path 114, and stopped at a creasing position (FIG. 4). The creasing position is determined by the timing at which the inlet sensor SN1 detects the front end of the sheet and a size of the sheet.

Figure 5:
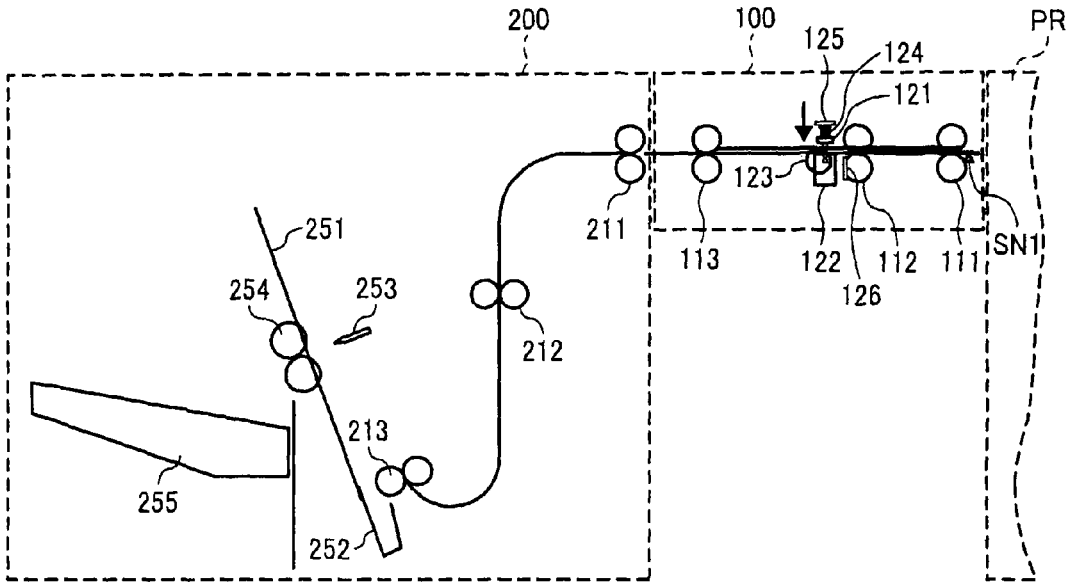
FIG. 5 is an explanatory diagram illustrating the sequence of operations of the image forming system when performing the folding process, and shows a state where a creasing process is being performed on the sheet.
Figure 6:
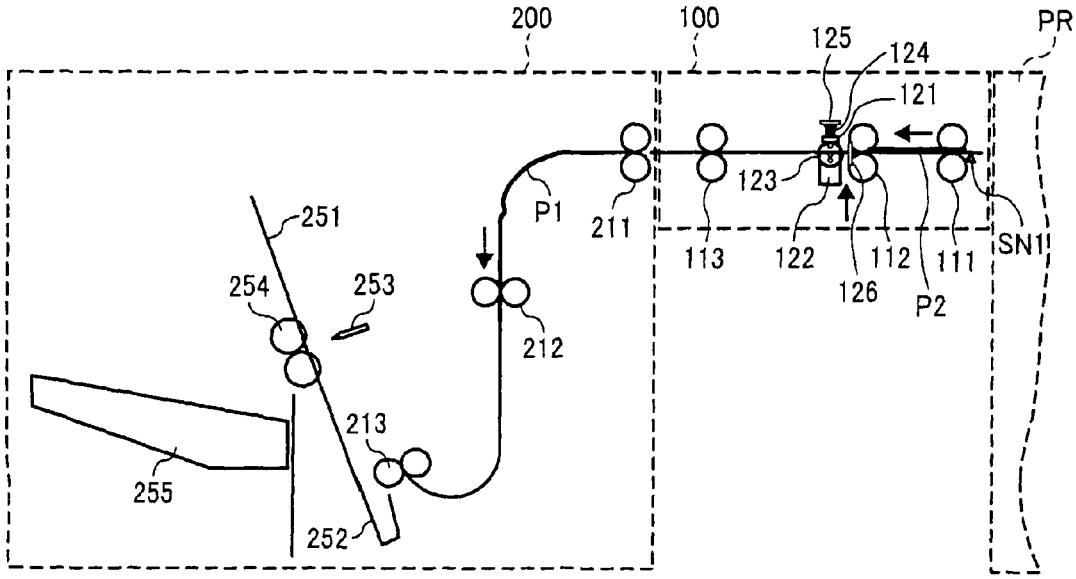
FIG. 6 is an explanatory diagram illustrating the sequence of operations of the image forming system when performing the folding process, and shows a state where the sheet on which the crease has been made is introduced into a sheet post-processing apparatus and a second sheet is introduced into the creasing device.
Figure 7:
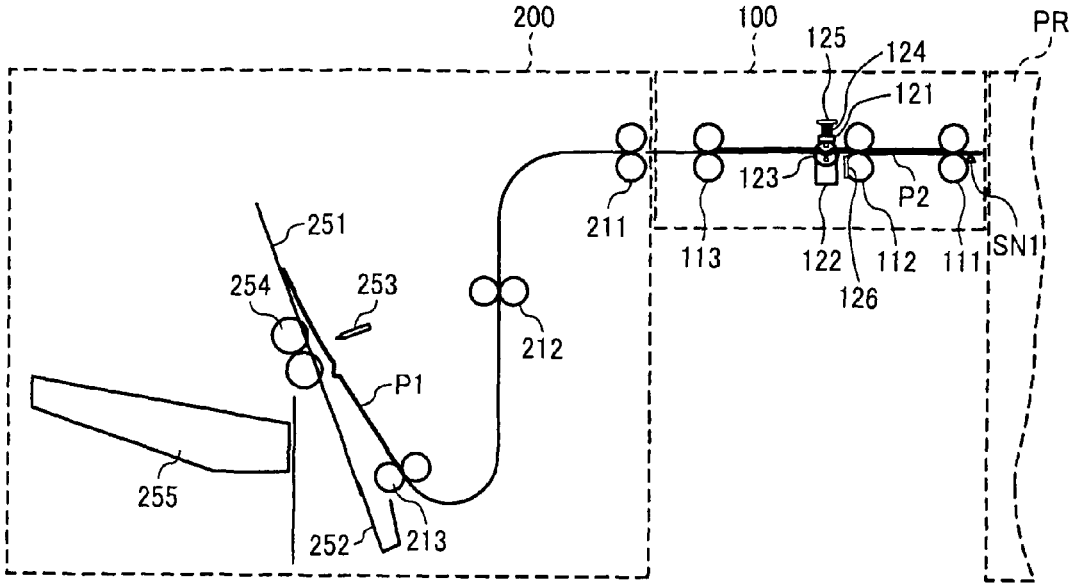
FIG. 7 is an explanatory diagram illustrating the sequence of operations of the image forming system when performing the folding process, and shows a state where a front end of the second sheet butts into the stopper plate in front of the creasing section.

Then, with respect to the sheet P1 stopped at this position, the drive cam 123 rotates, and the creasing member 121 moves down and holds the sheet P1 between the creasing member 121 and the creasing board 122. At this time, the creasing member 121 is pressurized at a predetermined elastic force by the elastic member 124, and a crease is made in the sheet P1 by the pressure force (FIG. 5). After that, the sheet P1, on which the crease has been made, is conveyed to the fold processing apparatus 200 (FIG. 6), and temporarily stored in the center-fold processing tray 251 (FIG. 7). During that time, a next sheet P2 is introduced from the image forming apparatus PR into the creasing device 100.

Figure 8:
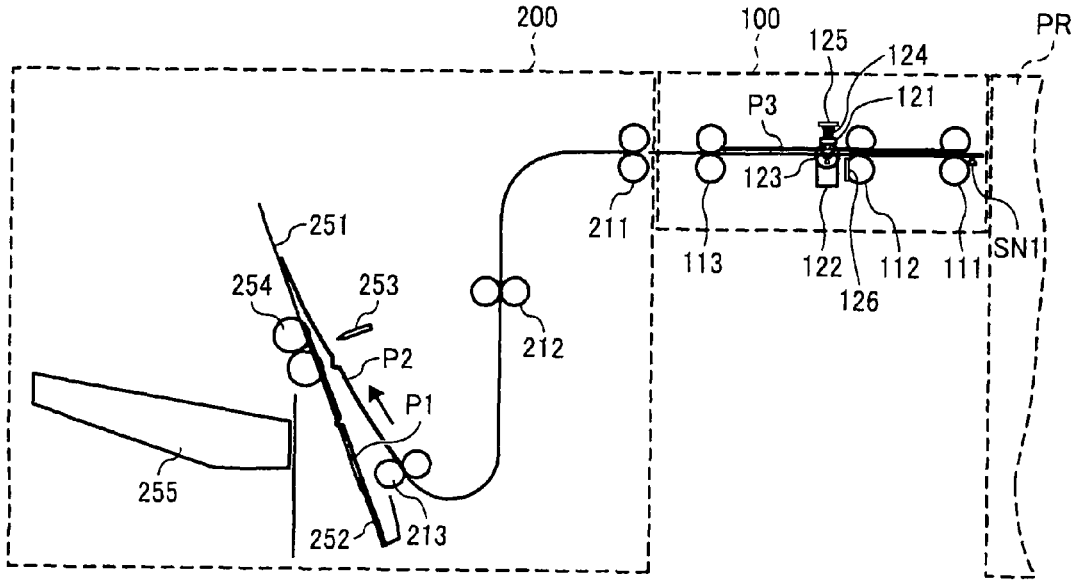
FIG. 8 is an explanatory diagram illustrating the sequence of operations of the image forming system when performing the folding process, and shows a state where the creasing process is performed on a third sheet.
Figure 9:
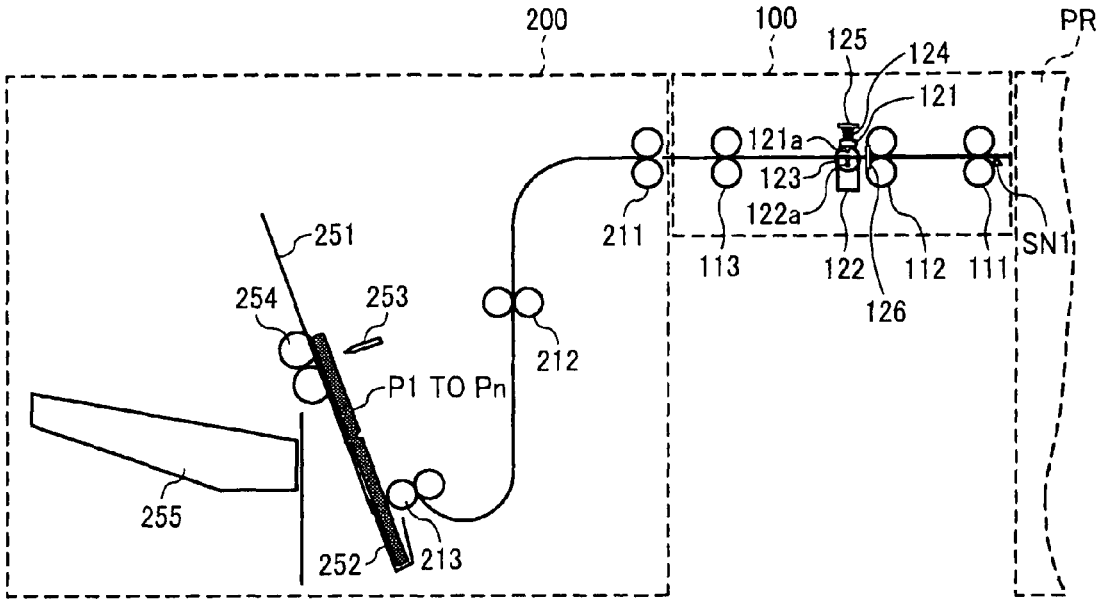
FIG. 9 is an explanatory diagram illustrating the sequence of operations of the image forming system when performing the folding process, and shows a state where the last sheet is accumulated on a center-fold processing tray.
Figure 10:
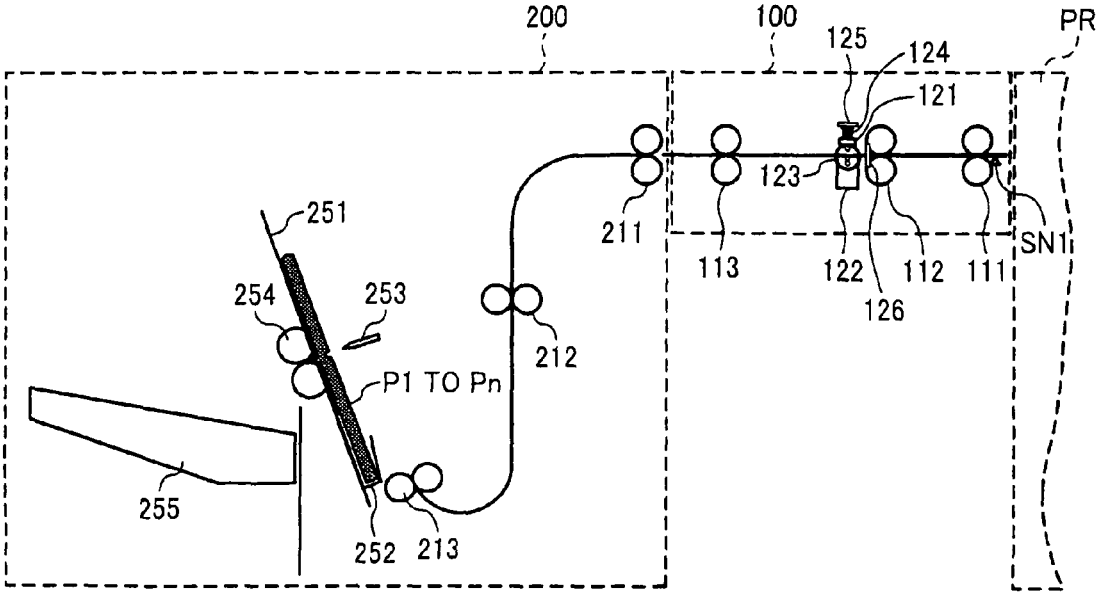
FIG. 10 is an explanatory diagram illustrating the sequence of operations of the image forming system when performing the folding process, and shows a state where, a bundle of the sheets is moved to a center-fold position from the state shown in FIG. 9.
Figure 11:
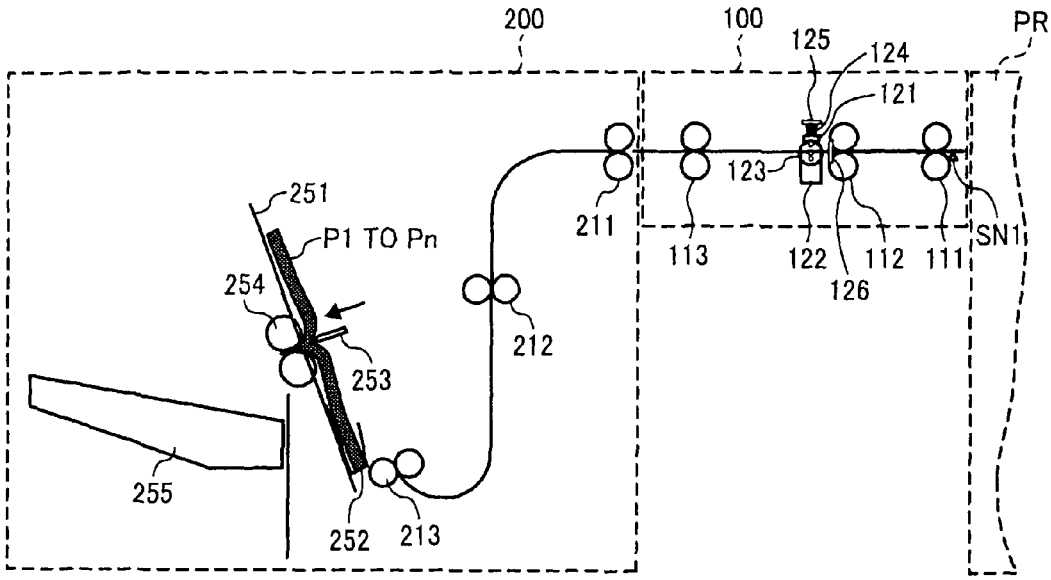
FIG. 11 is an explanatory diagram illustrating the sequence of operations of the image forming system when performing the folding process, and shows a state where a center-folding process is being performed on the sheet bundle in the state shown in FIG. 10.
Figure 12:
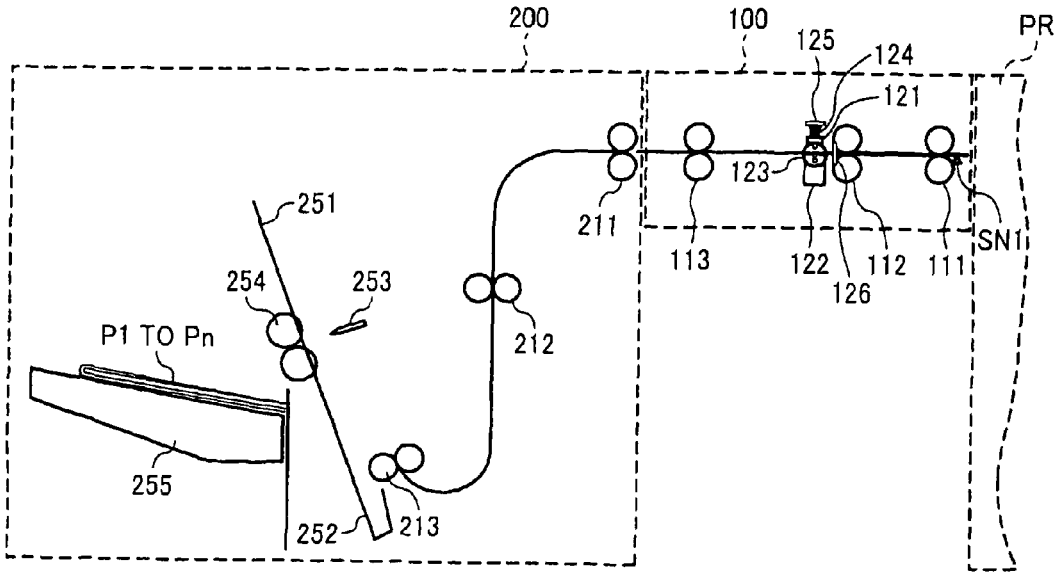
FIG. 12 is an explanatory diagram illustrating the sequence of operations of the image forming system when performing the folding process, and shows a state where the center-folded sheet bundle is discharged onto a catch tray.

The same operations illustrated in FIGS. 2 to 7 are repeatedly performed for the predetermined number of sheets (FIG. 8). When a sheet bundle composed of the predetermined number of sheets (P1 to Pn) is stored in the center-fold processing tray 251 (FIG. 9), the back end fence 252 is moved upward to set a fold portion of the sheet bundle to a folding position (FIG. 10). After that, the folding process is performed, i.e., the folding plate 253 is pressed onto against a portion of the crease made on the sheets, thereby pushing the sheet bundle into the nip of the folding rollers 254 (FIG. 11). Then, the sheet bundle subjected to the folding process is formed into a booklet, and sequentially stacked on the catch tray 255 (FIG. 12).

These are a sequence of the operations from the creasing process to the folding process with respect to a bundle of sheets. Although it is not illustrated in the drawing, in other fold modes such as three-fold, Z-fold, and double gatefold, as many creases as the number of times of folding processes are made by the creasing device 100.

The creasing mechanism 120 is explained in more detail.

Figure 13:
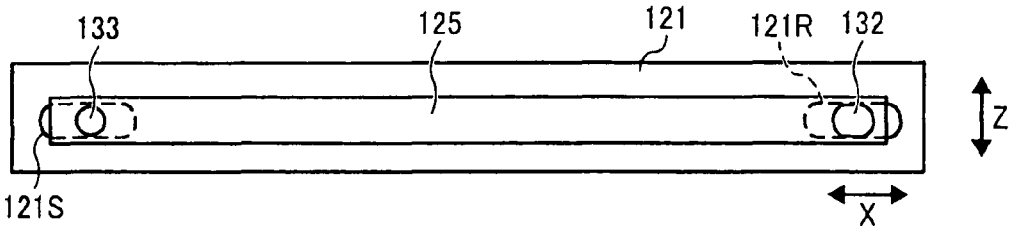
FIG. 13 is a plan view of a creasing mechanism.
Figure 14:
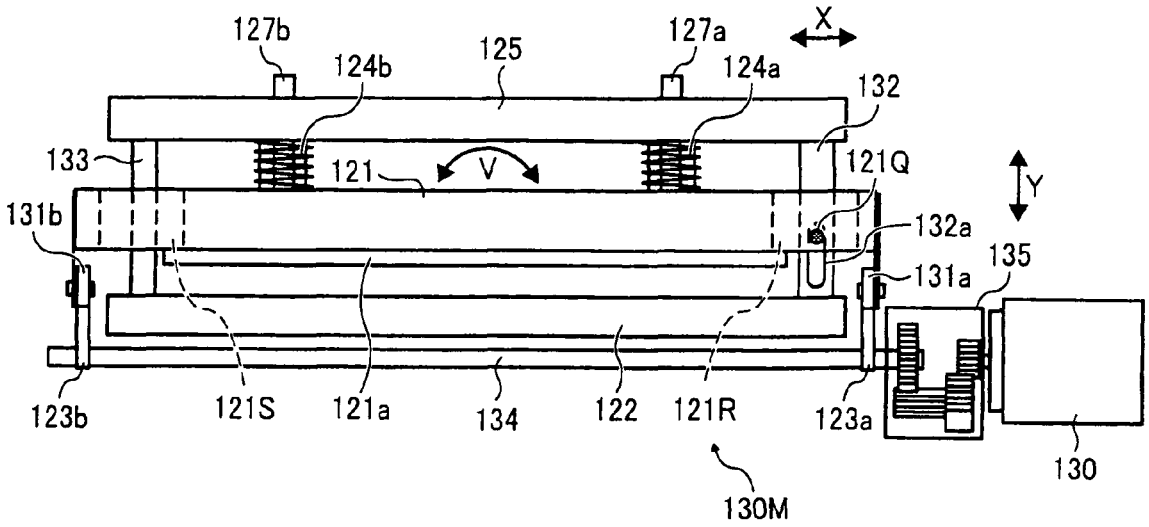
FIG. 14 is a side view of the creasing mechanism.

FIG. 13 is a plan view of the creasing mechanism 120, and FIG. 14 is a side view of the creasing mechanism 120. In FIGS. 13 and 14, the creasing mechanism 120 includes the creasing member 121, the creasing board 122, and a drive mechanism 130M.

In addition to the creasing blade 121*a* installed on the lower end of the creasing member 121, first and second long holes 121R and 121S, into which first and second support shafts 132 and 133 described below are loosely fitted respectively, are formed on the front and back sides of the creasing member 121; further, first and second positioning members 131*a* and 131*b* are installed at a back end portion and a front end portion of the creasing member 121, respectively. The first and second long holes 121R and 121S are formed to extend in the direction perpendicular to the sheet conveying direction. The first and second long holes 121R and 121S allow a plane surface of the creasing member 121 perpendicular to the sheet conveying direction to relatively oscillate between the first and second support shafts 132 and 133, and prevent the plane surface from moving in the sheet conveying direction. The first and second positioning members 131*a* and 131*b* hang substantially downward in a vertical direction from the back end portion and the front end portion of the creasing member 121, respectively. The first and second positioning members 131*a* and 131*b* are a disk-like cam follower of which the center is rotatably supported, and rotate while being contact with the drive cams 123.

The creasing board 122 is connected to the spring fixation member 125 arranged above the creasing member 121 via the first and second support shafts 132 and 133, and moves integrally with the spring fixation member 125. First and second shaft members 127*a* and 127*b* (collectively referred to as "a shaft member 127") are installed on the back and front sides of the spring fixation member 125 to extend toward the creasing member 121. First and second elastic members 124*a* and 124*b* (collectively referred to as "an elastic member 124"), which are back-side and front-side elastic members, are attached to the outer circumferences of the shaft members 127*a* and 127*b*, respectively. The first and second elastic members 124*a* and 124*b* constantly elastically bias the spring fixation member 125 and, eventually, the creasing board 122 upward. The first support shaft 132 is formed to have such a shape that a short side of a rectangular cross-section of the first support shaft 132 is semicircular, and to loosely fitted into the first long hole 121R. On a lower half portion of the first support shaft 132, a third long hole 132*a* that extends in an up-down direction of the first support shaft 132 is formed. A rotating shaft 121Q is vertically (vertically on the plane of the drawing sheet in FIG. 14) inserted into the third long hole 132*a* from the side of the side surface of the creasing member 121. A diameter of the rotating shaft 121Q is set to have a dimension allowing the movement in a direction Y and disallowing movement in a direction X in FIG. 14 with respect to a width dimension of the third long hole 132*a*. Consequently, the first support shaft 132 can rotate around the rotating shaft 121Q, and can move in a direction of the long side of the third long hole 132*a*. Due to these configurations, oscillation as indicated by an arrow V in FIG. 14 can occurr.

The drive mechanism 130M is a mechanism that drives drive cams 123*a* and 123*b* having contact with the positioning members 131*a* and 131*b* to rotate thereby pressing the creasing member 121 against the creasing board 122 and moving the creasing member 121 away from the creasing board 122. The drive mechanism 130M includes a camshaft 134 for coaxially connecting the first and second drive cams 123*a* and 123*b* on back and front portions thereof, a drive gear train 135 for driving the camshaft 134 on the side of an end portion (a back end portion, in the present embodiment) of the camshaft 134, and a drive motor 130 for driving the drive gear train 135. The first and second drive cams 123*a* and 123*b* are arranged at the positions where the first and second drive cams 123*a* and 123*b* are opposed to the first and second positioning members 131*a* and 131*b* and have contact with the first and second positioning members 131*a* and 131*b*, respectively. The first and second drive cams 123*a* and 123*b* causes the creasing member 121 to come close to and away from the creasing board 122 depending on a distance between the two on a line connecting the center of the camshaft 134 with the rotation center of each of the positioning members 131*a* and 131*b*. At this time, the moving position of the creasing member 121 is controlled by the first and second support shafts 132 and 133 and the first and second long grooves (holes) 121R and 121S, and the creasing member 121 reciprocates in a state where the movement of the creasing member 121 is controlled. At this time, due to the shape of the first and second drive cams 123*a* and 123*b*, the creasing blade 121*a* of the creasing member 121 is set not to move in parallel to the creasing board 122 but to have contact with a sheet at an angle so as to make a crease obliquely with respect to the sheet.

FIGS. 15 to 20 are explanatory diagrams illustrating the operation when a crease is made on a sheet by the creasing member 121. The creasing operation is initiated when the drive motor 130 starts rotating in accordance with an instruction from a control circuit (not shown).

Figure 15:
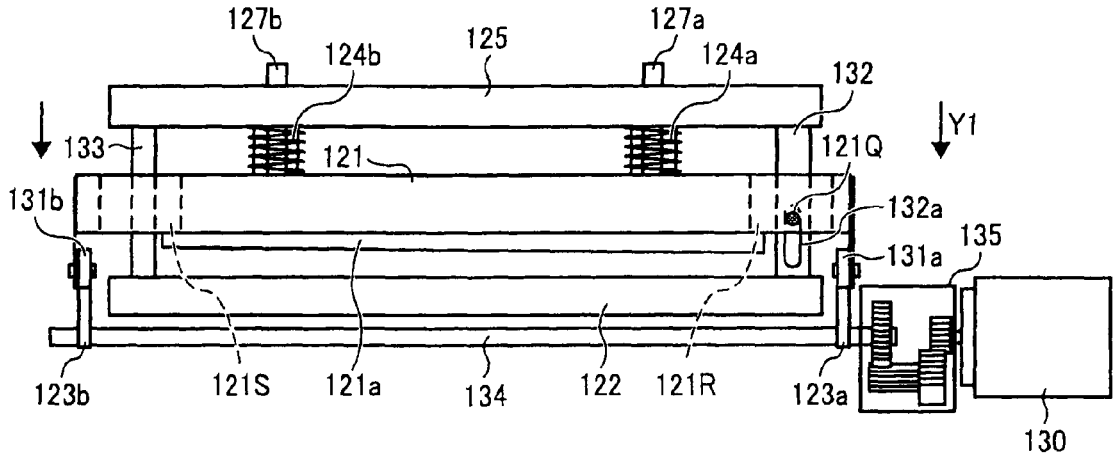
FIG. 15 is an explanatory diagram illustrating operations of the creasing mechanism when making a crease in a sheet, and shows an initial state where a creasing member is retracted away from a creasing position.

Namely, when the drive motor 130 rotates from a default position, i.e., a position in a state shown in FIG. 15 (a state where a sheet is conveyed and stopped at the creasing position), the camshaft 134 rotates via the drive gear train 135, and the first and second drive cams 123*a* and 123*b* rotate. In accordance with the rotation of the first and second drive cams 123*a* and 123*b*, the first and second positioning members 131*a* and 131*b*, which have contact with the first and second drive cams 123*a* and 123*b* and follow the respective drive cams as a cam follower, rotate, and a distance between the central axes of the positioning member and the drive cam varies, and the creasing member 121 moves in a direction of an arrow Y1.

Figure 16:
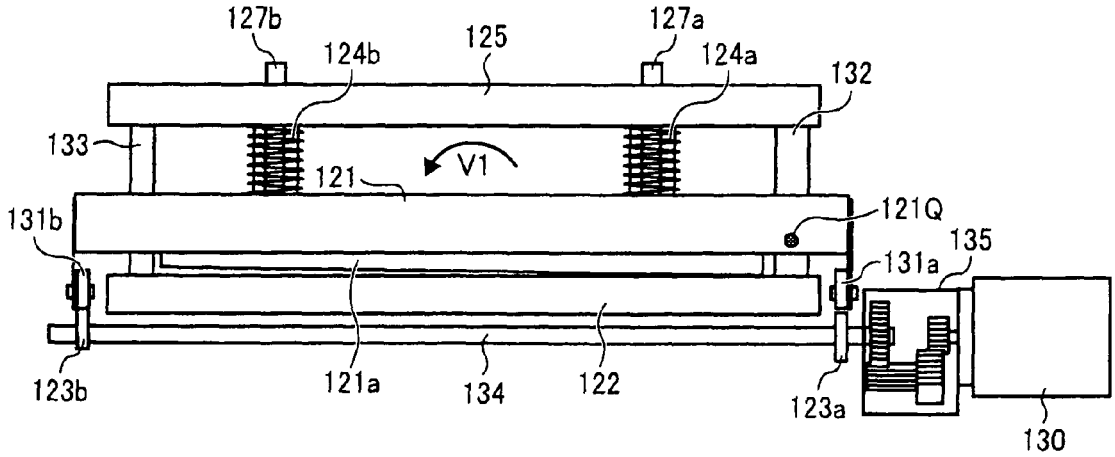
FIG. 16 is an explanatory diagram illustrating the operations of the creasing mechanism when making a crease in a sheet, and shows a state where a creasing blade has a contact with a creasing board through the sheet (not shown)

As shown in FIG. 16, when the creasing blade 121*a* has contact with the creasing board 122 via the sheet (not shown), the movement of the creasing member 121 is restricted by the creasing board 122. From this state, when the drive unit further rotates, the first drive cam 123*a* moves away from the first positioning member 131*a*. At this time, a portion of the creasing blade 121*a* of the creasing member 121 on the front side of the device does not have contact with the creasing board 122, so it is in a state where the second drive cam 123*b* has contact with the second positioning member 131*b*.

Figure 17:
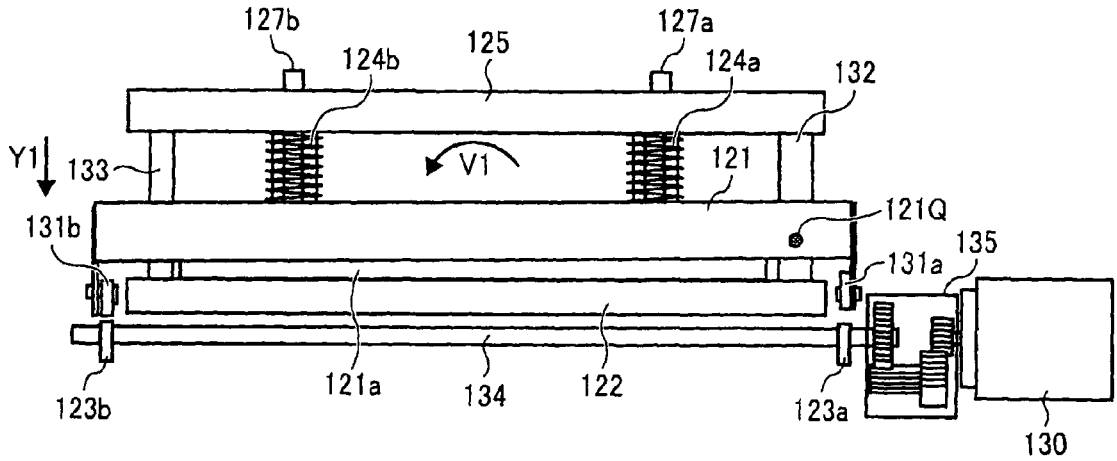
FIG. 17 is an explanatory diagram illustrating the operations of the creasing mechanism when making a crease in a sheet, and shows a state where a portion of the creasing blade on the front side of the device has a contact with a creasing groove on the creasing board and a crease is to be made in the sheet.

From the state shown in FIG. 16, when the drive motor 130 further rotates as shown in FIG. 17, the portion of the creasing blade 121*a* on the front side of the device also comes in contact with the creasing groove 122*a* of the creasing board 122. Consequently, the sheet is pressurized by elastic forces of the first and second elastic members 124*a* and 124*b*, and a crease is made in the sheet.

Figure 18:
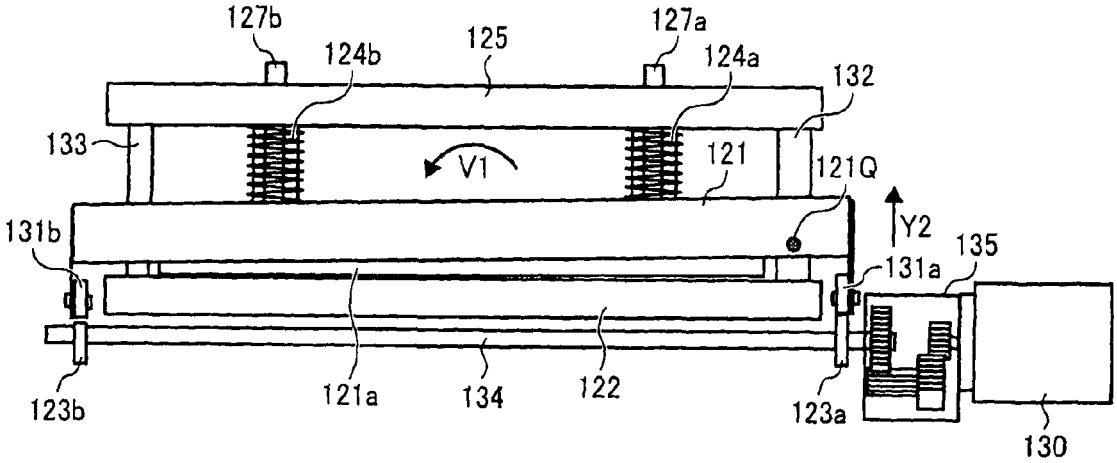
FIG. 18 is an explanatory diagram illustrating the operations of the creasing mechanism when making a crease in a sheet, and shows a state where the creasing member is retracted away from the creasing position after the crease is made in the sheet.
Figure 19:
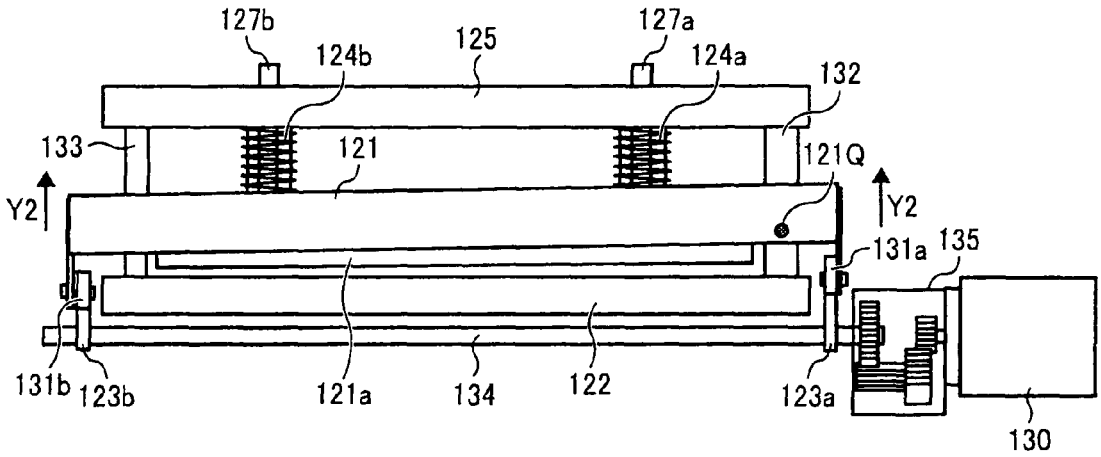
FIG. 19 is an explanatory diagram illustrating the operations of the creasing mechanism when making a crease in a sheet, and shows a state where the creasing member moves away parallel to the creasing board after the crease is made in the sheet.

After the crease is made on the sheet, the drive motor 130 further rotates, and the camshaft 134 and the first and second drive cams 123*a* and 123*b* rotate, and as shown in FIG. 18 the first drive cam 123*a* has contact with the first positioning member 131*a* first, and pushes up the first positioning member 131*a* located on the back side, and the back side of the creasing member 121 moves up in a direction of an arrow Y2 first. As shown in FIG. 19, when a lower end of the creasing blade 121*a* on the side of the first positioning member 131*a*, i.e., on the back side moves away from the creasing board 122, the second drive cam 123*b* has contact with the second positioning member 131*b* on the front side of the device, and the face on the side of the positioning member 131*b* also moves up in the direction of the arrow Y2.

Figure 20:
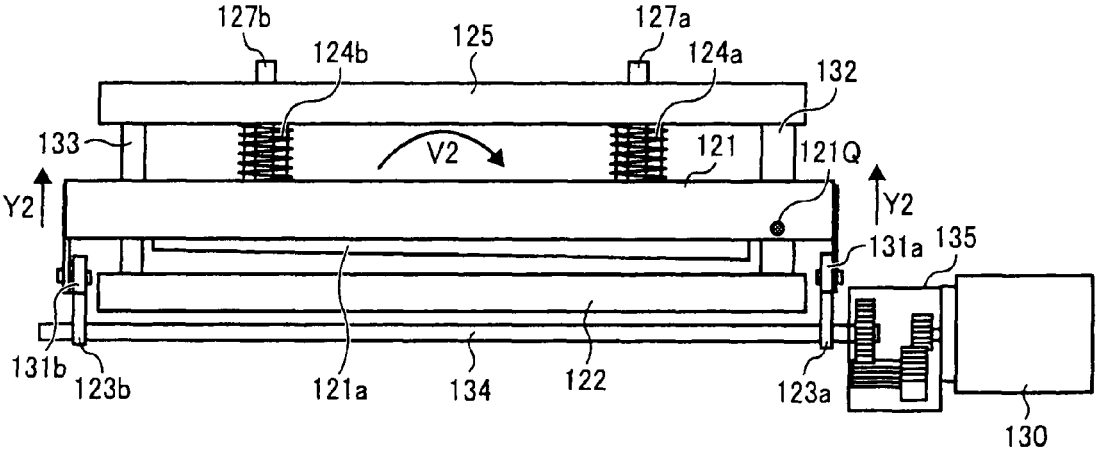
FIG. 20 is an explanatory diagram illustrating the operations of the creasing mechanism when making a crease in a sheet, and shows a state where the creasing member returns to the initial state.

The lower end of the creasing blade 121*a* on the side of the first positioning member 131*a* stops at the position away from the creasing board 122 for a while, and when the upper side face of the creasing member 121 becomes horizontal as shown in FIG. 20, the creasing member 121 moves up with keeping the horizontal position, and returns to the standby position, i.e., the default position shown in FIG. 16. At the default position, the creasing member 121 is tilted so that the back side of the creasing blade 121*a* is closer to the creasing board 122 than the front side.

In the course of this, after the portion of the creasing blade 121*a* on the back side of the device has contact with the creasing board 122 as shown in FIG. 16, the creasing blade 121*a* rotates counterclockwise as shown in the drawing (a direction of an arrow V1), and the both end sides move upward in the direction of the arrow Y2 as shown in FIG. 19, and after that, the creasing member 121 rotates clockwise in the drawing (a direction of an arrow V2) as shown in FIG. 20. As a result, an oscillation support is formed at the front end, and a crease is made by an oscillation movement around the back side of the device as a support point like a movement of a cutter which cuts a sheet by pressing against the sheet. This movement is generated due to the cam shape of the first and second drive cams 123*a* and 123*b*.

Figures 21, 21A:
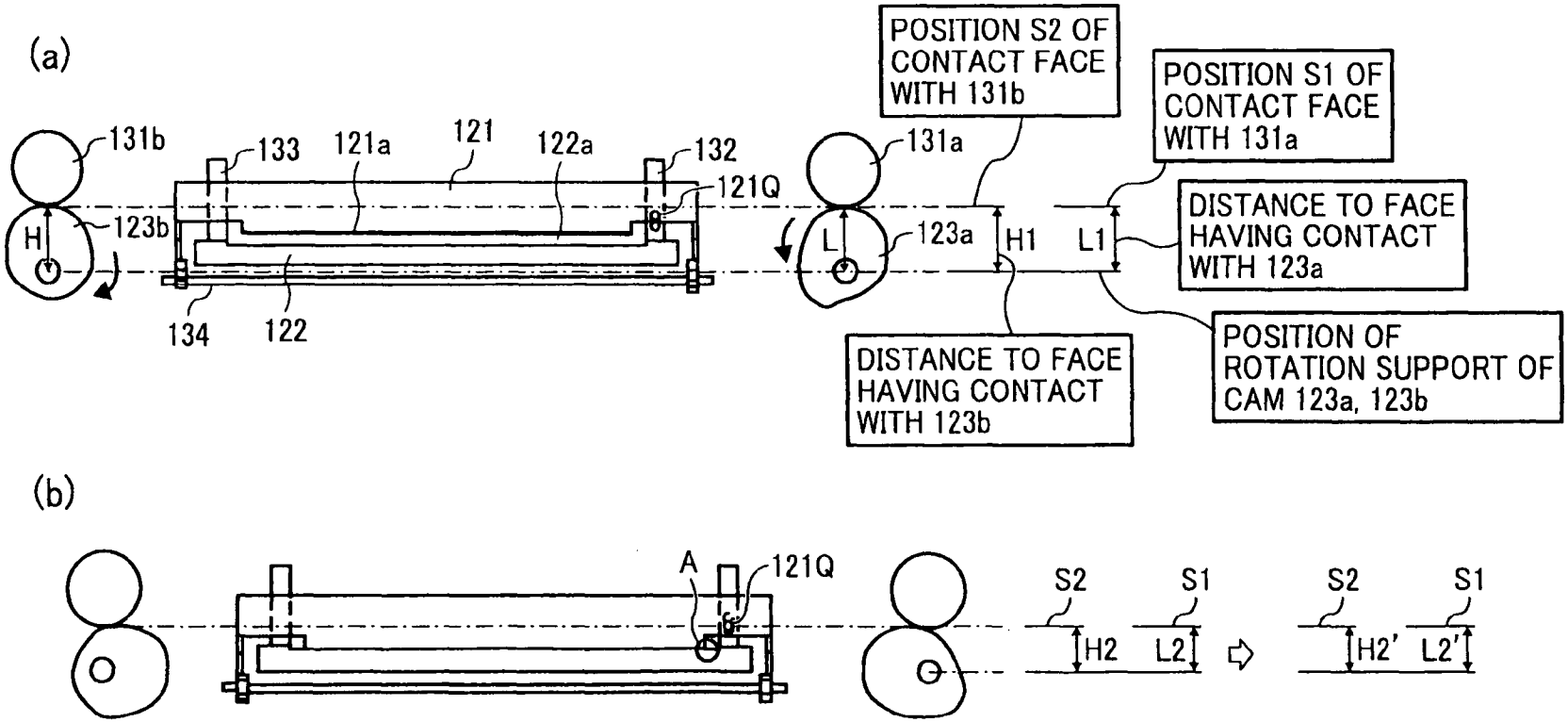
FIG. 21 is a movement explanatory diagram illustrating a change in a positional relation between the creasing board and the creasing member in accordance with a change in a positional relation between a drive cam and a positioning member.
Figure 21B:
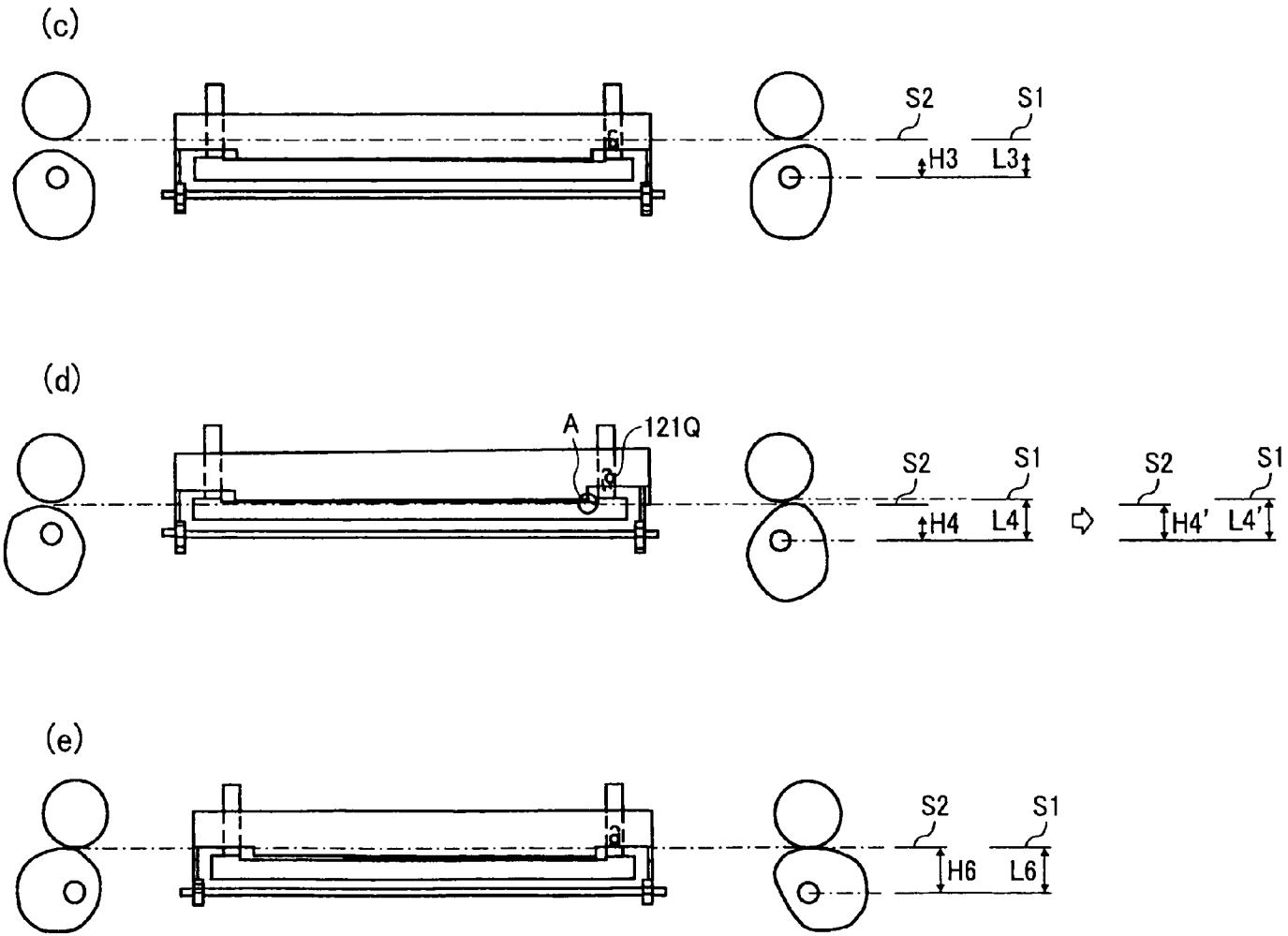

FIG. 21 is a movement explanatory diagram illustrating a change in a positional relation between the creasing board 122 and the creasing member 121 in accordance with a change in a positional relation between the drive cam 123 and the positioning member 131. FIG. 21 shows a relation of the rotational positions of the first drive cam 123*a* and the first positioning member 131*a*, which are located on the back side of the device, on the right-hand side of the drawing; a relation of the rotational positions of the second drive cam 123*b* and the first positioning member 131*b*, which are located on the front side of the device, on the left-hand side of the drawing; and a positional relation between the creasing groove 122*a* of the creasing board 122 and the creasing blade 121*a* of the creasing member 121 in accordance with the rotation of the first and second drive cams 123*a* and 123*b* in the middle of the two.

In FIG. 21, (a) shows the position of the creasing blade 121*a* with respect to the creasing board 122 in a period of time from when a sheet is introduced till when the sheet is conveyed and stopped at the folding position. This position is the default position. In FIG. 21, a distance L indicates a distance from the center of the cam shaft 134 of the first drive cam 123*a* to a contact point (the outer circumferential surface) between the first positioning member 131*a* and the first drive cam 123*a* on a line connecting the center of the cam shaft 134 of the first drive cam 123*a* with the center of the rotating shaft of the first positioning member 131*a*. Furthermore, a distance H indicates a distance from the center of the cam shaft 134 of the second drive cam 123*b* to a contact point (the outer circumferential surface) between the second positioning member 131*b* and the second drive cam 123*b* on a line connecting the center of the cam shaft 134 of the second drive cam 123*b* with the center of the second positioning member 131*b*.

When the position of a contact point between the first drive cam 123*a* and the first positioning member 131*a* in (a) is denoted by S1, and the position of a contact point between the second drive cam 123*b* and the second positioning member 131*b* in (a) is denoted by S2, a relation between the position S1 of the contact point and the distance L1 and a relation between the position S2 of the contact point and the distance H1 are as follows:

$$S1=L1$$

$$S2=H1$$

$$H1=L1$$

In this state, a relation between the creasing blade 121*a* and the creasing groove 122*a* is in the positional relation shown in FIG. 15, and a space between the creasing blade 121*a* and the creasing groove 122*a* on the back side is narrower than that is on the front side. Incidentally, "H" denotes a distance to a contact point with the cam follower of the second drive cam 123*b*, and "L" denotes a distance to a contact point with the cam follower of the first drive cam 123*a*.

(b) in FIG. 21 shows a state of the components when a portion A, a backmost end portion, of the creasing blade 121*a* has contact with the creasing board 122. The position of the portion A is set to be located on the outside of an end portion of a maximum-size sheet that is subject to the creasing process in the present embodiment, and the front side comes down around the portion A on the outside (the back side). A relation between a distance H2 and a distance L2 in a period of time from the start of the movement till when the portion A of the creasing blade 121*a* has contact with the creasing board 122 is H2=L2, and the both move (come down) for the same distance at the same time. FIG. 16 corresponds to this positional relation.

After the portion A has contact with the creasing board 122, and when the first and second drive cams 123*a* and 123*b* further rotate as shown in (b), a relation between the position S1 of the contact point and a distance L2' and a relation between the position S2 of the contact point and a distance H2' are as follows:

$$S1>L2'$$

$$S2=H2'$$

In the course of this, the creasing member 121 rotates around the rotation shaft 121Q.

(c) in FIG. 21 shows the positions when the creasing member 121 rotates around the rotation support Q and the edge face of the creasing blade 121*a* has contact with the creasing groove 122*a* of the creasing board 122. As can be seen from (c), a relation between the position S1 of the contact point and a distance L3 and a relation between the position S2 of the contact point and a distance H3 when the edge face of the creasing blade 121*a* has contact with the creasing groove 122*a* of the creasing board 122 are as follows:

$$S1>L3$$

$$S2>H3$$

where, in both, the distance is smaller than the position of contact point. Consequently, the creasing member 121 is pressurized by the first and second elastic members 124*a* and 124*b*, and the creasing blade 121*a* is fitted into the creasing groove 122*a* of the creasing board 122 via a sheet, and a crease is made on the sheet. FIG. 17 corresponds to this positional relation.

(d) in FIG. 21 shows the positions when the portion A of the creasing blade 121*a* moves away from the creasing board 122. A relation between the position S1 of the contact point and a distance L4 and a relation between the position S2 of the contact point and a distance H4 when the portion A of the creasing blade 121*a* moves away from the creasing board 122 are as follows:

$$S1=L4$$

$$S2>H4$$

and after that, the relations become as follows:

$$S1=L4'$$

$$S2=H4'$$

FIG. 18 corresponds to this positional relation.

The position S1 of the contact point on the back side is stopped until the position S2 of the contact point on the front side comes to the position of the contact point on the back side, and as shown in (e) in FIG. 21, after the relation becomes S1=S2, the creasing member 121 returns to the standby position shown in (a).

Incidentally, the cam shapes of the drive cams 123*a* and 123*b* are set so that, as shown in (d), after the movement for separation is started, the moving speed is accelerated.

By the movements described above, a crease is made on each sheet, and the sheet is conveyed to a sheet post-processing apparatus.

In a conventional creasing device, when the overall creasing blade simultaneously contacts with a sheet in the width direction, the face pressure is increased, and the load at the time of movement increases. However, in the invention of the present application, instead of such face contact, the creasing blade is brought into contact with a sheet gradually from point contact to line contact, or to face contact, so that the contact pressure can be distributed. As a result, the load at the time of operation can be reduced. Furthermore, the number of times that the creasing blade contacts a sheet is just once, so that it can avoid making an uneven crease on the sheet.

According to the present invention designed as above, a crease is made in a sheet gradually from an edge face of the sheet, and therefore, it is possible to reduce the load at the time of creasing, and it is also possible to improve the productivity and energy consumption by shortening the processing time.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device for making a crease on one sheet each, the creasing device comprising:

a first member on which a linear convex-edged blade is formed in a direction perpendicular to a sheet conveying direction;

a second member on which a concave-edged blade pairing with the convex-edged blade is formed; and a drive unit that drives the first and second members to relatively come close to and away from each other, thereby causing the first member and second member to hold the sheet that is stopped at a set position therebetween and make a crease on the sheet, wherein when in a standby state, the drive unit keeps the first member and second member in a state where a face of the convex-edged blade to have contact with the sheet is tilted so that a back side of the convex-edge blade is closer to the second member than a front side of the convex-edge blade; and at the time of making a crease on the sheet, the drive unit causes the first member and second member to be in a state where the convex-edged blade and the concave-edged blade have point contact with each other via the sheet held therebetween so as to initiate a creasing movement by a rotation movement thereof.

2. The creasing device according to claim 1, wherein the drive unit causes the first member to rotate while the first member and the second member are contacted thereof.

3. The creasing device according to claim 2, wherein a portion of the convex-edged blade having contact with the concave-edged blade as a supporting point makes the crease on the sheet.

4. The creasing device according to claim 1, further comprising an elastic member that makes the convex-edged blade and the concave-edged blade pressurized so as to make the crease on the sheet.

5. The creasing device according to claim 1, wherein the drive unit causes the first member to move away from the second member from a side of a portion of the convex-edged blade having started to contact with the concave-edged blade after the crease is made on the sheet by the first member.

6. The creasing device according to claim 5, wherein the drive unit accelerates moving speed of the first member with respect to the second member after the convex-edged blade has moved away from the sheet.

7. The creasing device according to claim 1, wherein a start position of the point contact is set at a position outside of paths of sheets in all sizes.

8. An image forming system comprising:

the creasing device according to claim 1; and an image forming apparatus that forms an image on the sheet.

* * * * *